US010828555B2

(12) United States Patent
Howell et al.

(10) Patent No.: US 10,828,555 B2
(45) Date of Patent: Nov. 10, 2020

(54) PORTABLE GAME WITH ROTATING CONTAINERS

(71) Applicant: Dick's Sporting Goods, Inc., Coraopolis, PA (US)

(72) Inventors: Jacob Ray Howell, Carnegie, PA (US); William E. Clegg, Gibsonia, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 0 days.

(21) Appl. No.: 16/263,682

(22) Filed: Jan. 31, 2019

(65) Prior Publication Data

US 2020/0246680 A1 Aug. 6, 2020

(51) Int. Cl.
*A63D 1/02* (2006.01)
*A63B 67/06* (2006.01)
*A63D 5/04* (2006.01)

(52) U.S. Cl.
CPC ..... *A63D 1/02* (2013.01); *A63B 67/06* (2013.01); *A63D 5/04* (2013.01)

(58) Field of Classification Search
CPC ..... A63B 67/06; A63D 1/02; A63D 5/04
USPC ..... 273/118 R, 118 A, 123 R, 123 A, 127 R, 273/127 B, 127 D
See application file for complete search history.

(56) References Cited

U.S. PATENT DOCUMENTS 3,451,682 A * 6/1969 Trimble ..... A63B 57/357 473/189
3,642,284 A * 2/1972 Kordek ..... A63F 7/3065 273/127 R
3,854,728 A * 12/1974 Brandell ..... A63F 7/3065 473/183
4,424,970 A * 1/1984 Halliburton ..... A63F 7/3065 273/121 A
4,953,865 A * 9/1990 Coombs ..... A63B 67/02 473/158
5,226,653 A * 7/1993 Bil ..... A63F 7/3065 273/118 A
5,322,283 A * 6/1994 Ritchie ..... A63F 7/3065 273/118 A
5,476,260 A * 12/1995 Ottley ..... A63B 67/002 273/118 R
5,741,010 A * 4/1998 Weyna ..... A63F 7/027 273/118 A
6,155,571 A * 12/2000 Reinertsen ..... A63B 63/06 273/127 D
7,261,293 B2 8/2007 Berger
7,500,674 B2 3/2009 Riley et al.
7,744,478 B1 6/2010 Chelak
9,820,569 B2 11/2017 Tsai
2007/0246882 A1* 10/2007 DiFrancesco, Jr. .. A63B 63/007 273/123 R (Continued)

*Primary Examiner* — Raleigh W Chiu
(74) *Attorney, Agent, or Firm* — Fox Rothschild LLP

(57) ABSTRACT

A portable game includes a playing surface having a first portion and a second portion, where the first portion has at least one container. Each container has an opening and is rotatably connected to the first portion, and each container is configured to rotate between a scoring position and a closed position. The opening of each container is configured to receive a game piece via the playing surface when that container is in the scoring position but not when that container is in the closed position. The portable game also includes one or more border rails that at least partially surround at least a portion of the playing surface.

14 Claims, 10 Drawing Sheets

(56) References Cited

U.S. PATENT DOCUMENTS

| | | | | |
|---|---|---|---|---|
| 2014/0265136 | A1* | 9/2014 | Parker | A63B 63/00<br>273/398 |
| 2015/0001796 | A1* | 1/2015 | Stellenberg | A63F 3/0052<br>273/121 A |

* cited by examiner

PORTABLE GAME WITH ROTATING CONTAINERS

BACKGROUND

Portable games are a fun and convenient way to entertain friends, family, and guests. Often, a portable game is a simplified and/or miniature version of a sport or recreational activity. The game with rotating containers that is described in this disclosure is a twist on traditional bowling that provides players with a portable and lighter weight alternative to traditional bowling which also requires skill and accuracy to keep the rotating containers in a scoring position once contact is made.

SUMMARY

In an embodiment, a portable game includes a playing surface having a first portion and a second portion, where the first portion has at least one container. Each container has an opening and is rotatably connected to the first portion, and each container is configured to rotate between a scoring position and a closed position. The opening of each container is configured to receive a game piece via the playing surface when that container is in the scoring position but not when that container is in the closed position. The portable game also includes one or more border rails that at least partially surround at least a portion of the playing surface.

Each container may be configured to automatically rotate from the scoring position to the closed position in response to receiving the game piece via its opening. Similarly, each container may be configured to automatically rotate from the closed position to the scoring position in response to the game piece being removed from the container.

The opening of each container may be substantially perpendicular to the playing surface when the container is in the scoring position. The opening of each container may be substantially coplanar to the playing surface when the container is in the closed position.

In various embodiments, the playing surface may include one or more ramp portions, where each ramp portion may be at least partially recessed below the playing surface at an angle. Each container may include a first fin extending from a side of the container, and a second fin extending from the side of the container. The first fin may include a first protrusion, and the second fin may include a second protrusion.

The playing surface may include a first opening positioned on one side of the ramp portion, and a second opening positioned on a second side of the ramp portion. The first opening may be configured to receive the first protrusion, and the second opening may be configured to receive the second protrusion. The at least one container may be configured to rotate about the first protrusion and the second protrusion.

The second portion of the playing surface may include one or more bumper holders having one or more protrusions, and one or more corresponding bumpers removeably attached to one or more of the bumper holders via one or more of the protrusions.

In various embodiments, each container includes a visual indication on an outer portion of the container as to a point score associated with the container.

In an embodiment, a portable game includes a playing surface having a first portion having a plurality of containers. Each container has an opening and is rotatably connected to the first portion. Each container is configured to rotate between a scoring position and a closed position. The opening of each container is configured to receive a game piece via the playing surface when that container is in the scoring position but not when that container is in the closed position. The playing surface includes a second portion having one or more bumper holders and one or more corresponding bumpers within the bumper holders. The playing surface also includes one or more border rails that at least partially surround at least a portion of the playing surface.

Each container may be configured to automatically rotate from the scoring position to the closed position in response to receiving the game piece via its opening. Similarly, each container may be configured to automatically rotate from the closed position to the open position in response to the game piece being removed from the container.

The opening of each container may be substantially perpendicular to the playing surface when the container is in the scoring position. The opening of each container may be substantially co-planar to the playing surface when the container is in the closed position.

Each container may include a visual indication on an outer portion of the container as to a point score associated with the container.

The playing surface may also include one or more ramp portions, where each ramp portion is at least partially recessed below the playing surface at an angle. Each container may include a first fin extending from a side of the container, and a second fin extending from the side of the container, wherein the first fin includes a first protrusion, and the second fin includes a second protrusion. The playing surface may include a first opening positioned on one side of the ramp portion, and a second opening positioned on a second side of the ramp portion. The first opening may be configured to receive the first protrusion, the second opening may be configured to receive the second protrusion, and the at least one container may be configured to rotate about the first protrusion and the second protrusion.

Optionally, the portable game may include one or more deflectors positioned on the playing surface between at least two of the plurality of containers.

DETAILED DESCRIPTION

As used in this document, the singular forms "a," "an," and "the" include plural references unless the context clearly dictates otherwise. Unless defined otherwise, all technical terms used herein have the same meanings as commonly understood by one of ordinary skill in the art. As used in this document, the term "comprising" (or "comprises") means "including (or includes), but not limited to."

In this document, when terms such as "first" and "second" are used to modify a noun, such use is simply intended to distinguish one item from another, and is not intended to require a sequential order unless specifically stated.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

The present disclosure generally relates to a portable game with rotating containers. References to various embodiments and examples set forth in this specification do not limit the scope of the disclosure and merely set forth some of the many possible embodiments of the appended claims.

Figure 1:
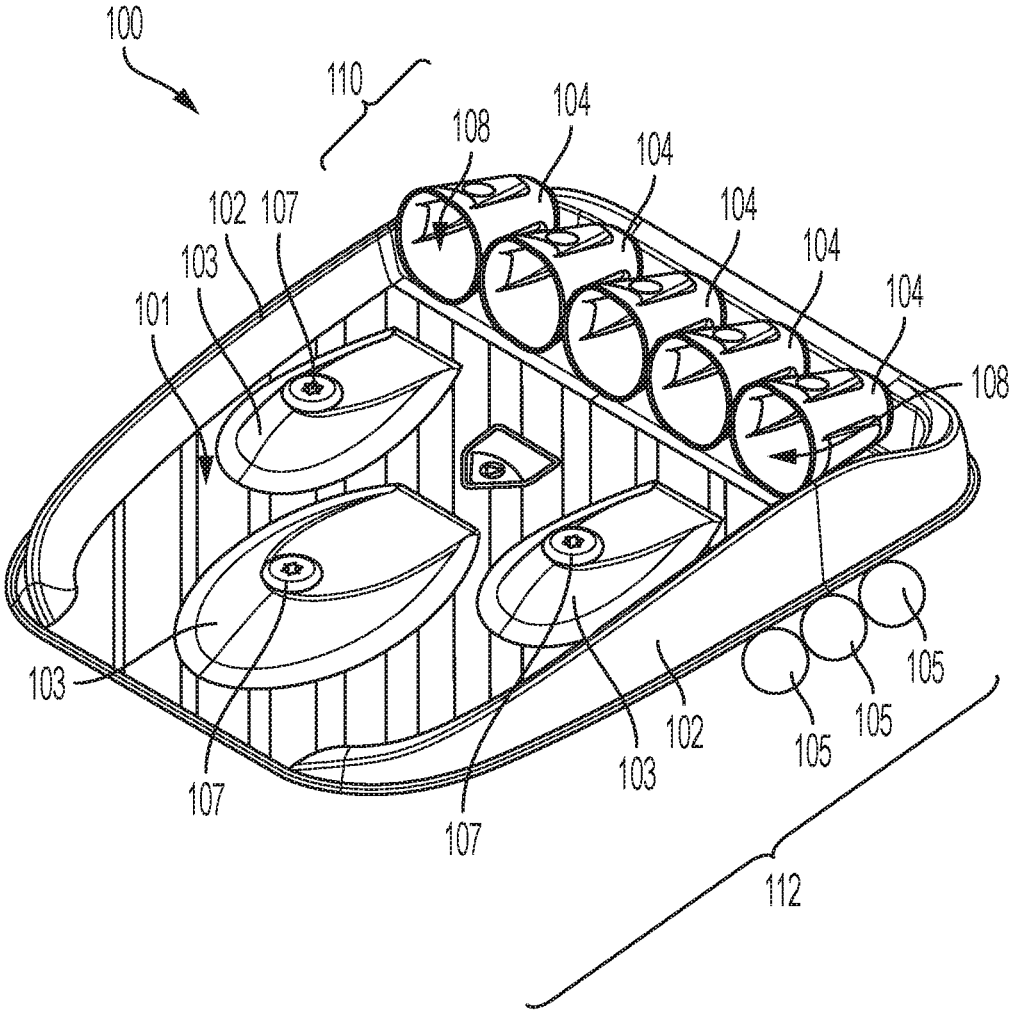
FIG. 1 illustrates an example portable game with rotating containers in a scoring position.
Figure 2:
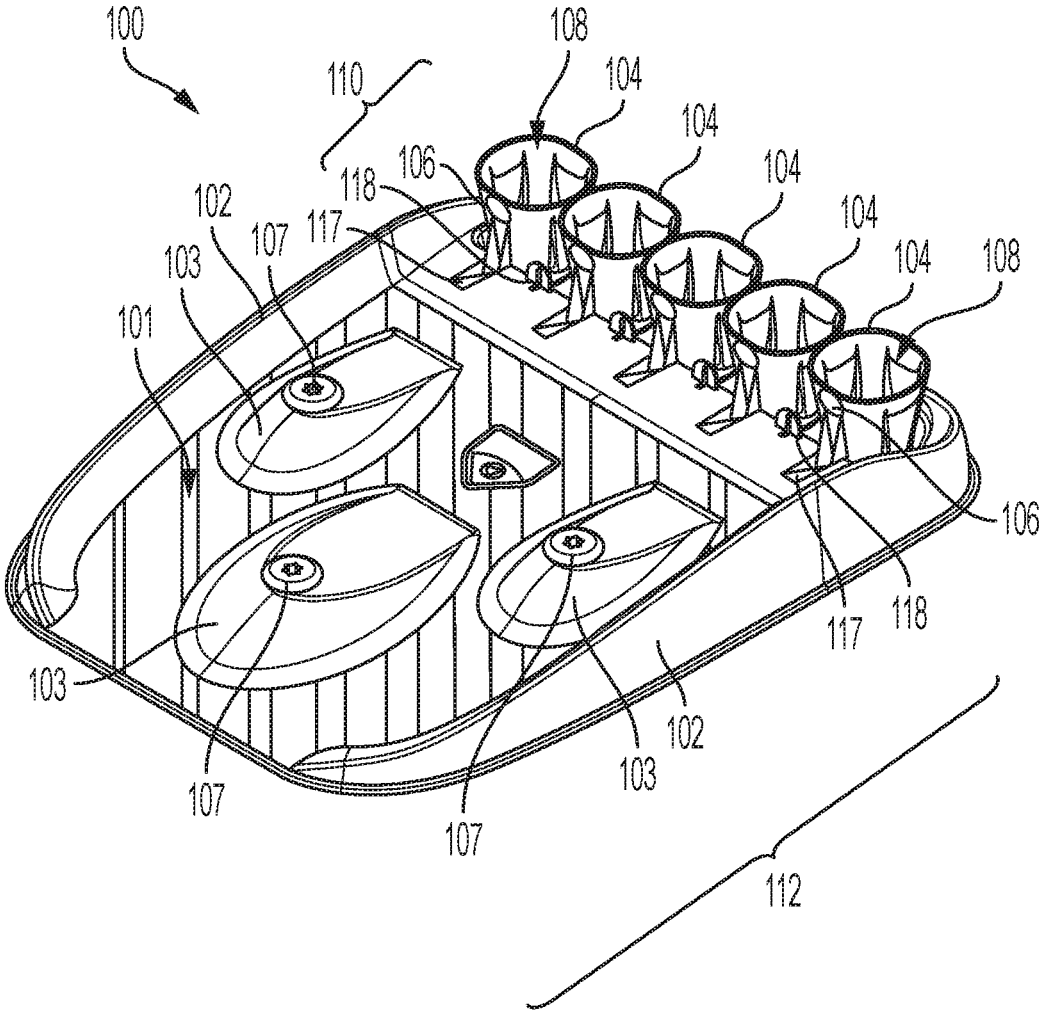
FIG. 2 illustrates an example portable game with rotating containers in a closed position.

FIGS. 1 and 2 each show an example portable game according to various embodiments. As shown in FIGS. 1 and 2, a portable game 100 includes a playing surface 101 and one or more border rails 102. One or more of the border rails 102 may be integrally formed as a part of the playing surface 101. Alternatively, one or more of the border rails 102 may be separately attached to the playing surface 101 by, for example, one or more screws or other connectors, or by a press-fit connection, a snap-fit connection or any other suitable connection.

In an embodiment, one or more of the border rails 102 may extend upwards and/or outwards from the playing surface 101 along one or more edges of the playing surface. In various embodiments, one or more border rails 102 may extend along at least a portion of a rear part of the playing surface. For instance, one or more border rails 102 may extend along a rear edge of the playing surface 101 behind one or more of the containers 104 of the portable game. As such, one or more of the border rails 102 may prevent a game piece 105 from sliding or rolling off of the playing surface 101. In other embodiments, a border rail 102 may be used as part of strategic game play to bounce or bank a game piece 105 into or towards a container 104.

As shown in FIGS. 1 and 2, the playing surface 101 may include one or more bumper holders 103. A bumper holder 103 may be integrally formed as part of the playing surface 101 or it may be separately attached to the playing surface 101 by for example, one or more screws or other connectors, or by a press-fit connection, a snap-fit connection or any other suitable connection. Each of the one or more bumper holders 103 are configured to receive and position a bumper 107 as described in more detail below. The playing surface 101 may also include a design and/or logo on the playing surface 101, as shown in FIGS. 1 and 2.

In an embodiment, the portable game 100 may include one or more containers 104 positioned on at least a portion of the playing surface 101. One or more of the containers 104 may have an opening 108 into which one or more game pieces 105 may be received, as shown in FIGS. 1 and 2. As described in more detail below, one or more of the containers 104 may be rotatable relative to the playing surface 101. A container 104 may rotate between a scoring position, in which a game piece may be received by the container, and a closed position. FIG. 1 shows example containers 104 in a scoring position. FIG. 2 shows example containers 104 in a closed position.

Figure 3:
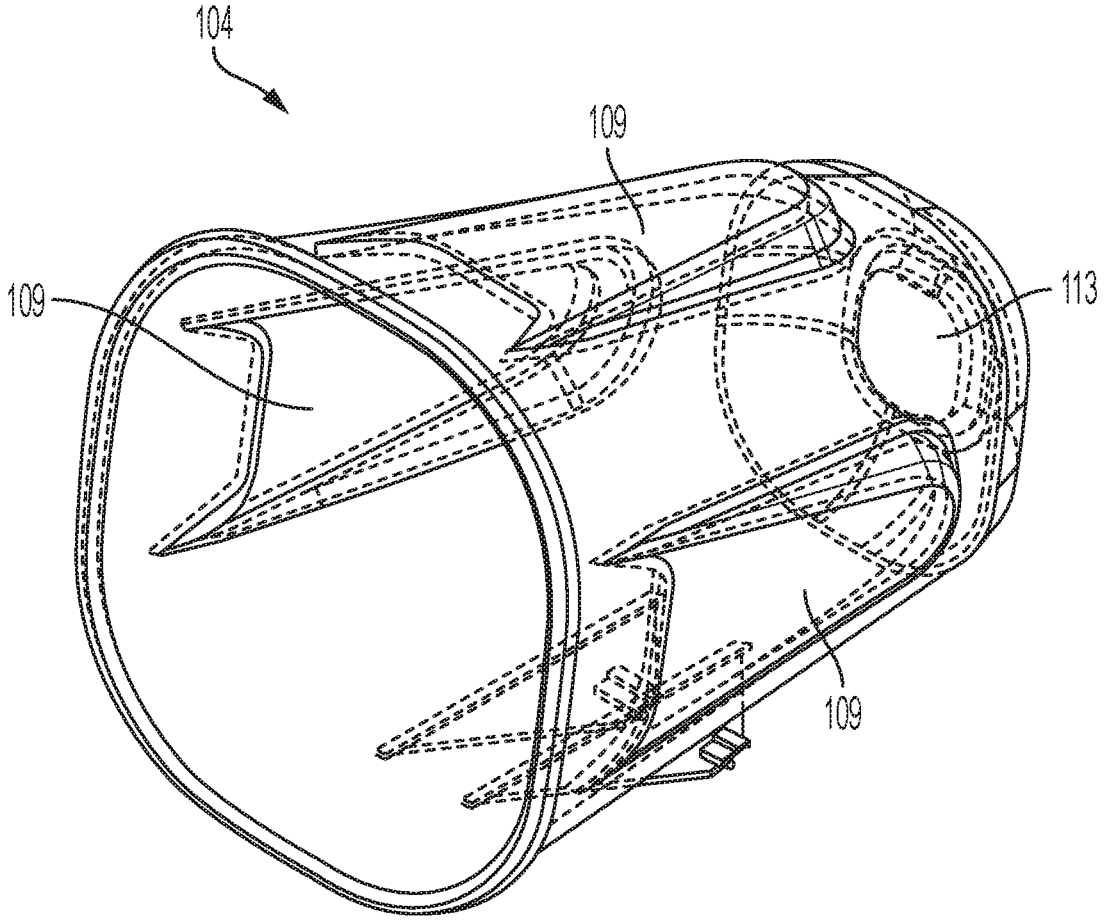
FIG. 3 illustrates an example container with boss portions and a deboss portion.

As shown in FIG. 3, one or more containers 104 may include one or more boss portions 109 on one or more sides of the container 104. For example, a container may include boss portions 109 on each side of the container except the side that contacts the playing surface when the container is in a scoring position. The one or more boss portions 109 may protrude outwards from the surface of the container 104. In an embodiment, one or more boss portions 109 may be formed integral with a container 104.

In an embodiment, as shown in FIG. 3, one or more containers 104 may include a deboss portion 113 on a surface of the container 104 that is opposite the opening 108 of the container. A deboss portion 113 refers to a recessed portion that extends inwardly from a surface. The boss portions 109 and/or the deboss portion 113 may add additional structural elements to the container which may help the container to absorb impact from a game piece 105 when it contacts the container 104. As such, boss portions 109 and/or deboss portions 113 may provide a container 104 with greater strength and durability.

The portable game 100 may be used with one or more game pieces 105. A game piece 105 refers to a portable object that is capable of being moved across at least a portion of the playing surface 101, and sized to be smaller than an opening 108 of a container 104 such that the game piece can be received by the container via the opening during play. Examples of game pieces 105 include without limitation, balls, discs, bean bags and/or the like.

FIG. 1 shows an example embodiment with three game pieces 105 positioned on a side of the portable game 100. However, it is understood that a different number of game pieces 105 may be utilized with a portable game of this disclosure according to various embodiments.

FIG. 2 shows that the playing surface 101 may also include one or more deflectors 118 according to an embodiment. A deflector 118 refers to a surface positioned between two containers 104 that prevents a game piece 105 from entering a gap between or behind one or more containers. In various embodiments, as illustrated in FIG. 2, a deflector 118 may be a surface that extends vertically from the playing surface 101 and is positioned in front of a gap between two containers 104. The deflectors 118 illustrated in FIG. 2 have a semi-circle or half-moon shape. However, differently shaped and/or sized deflectors 118 may be used according to this disclosure.

Figure 4:
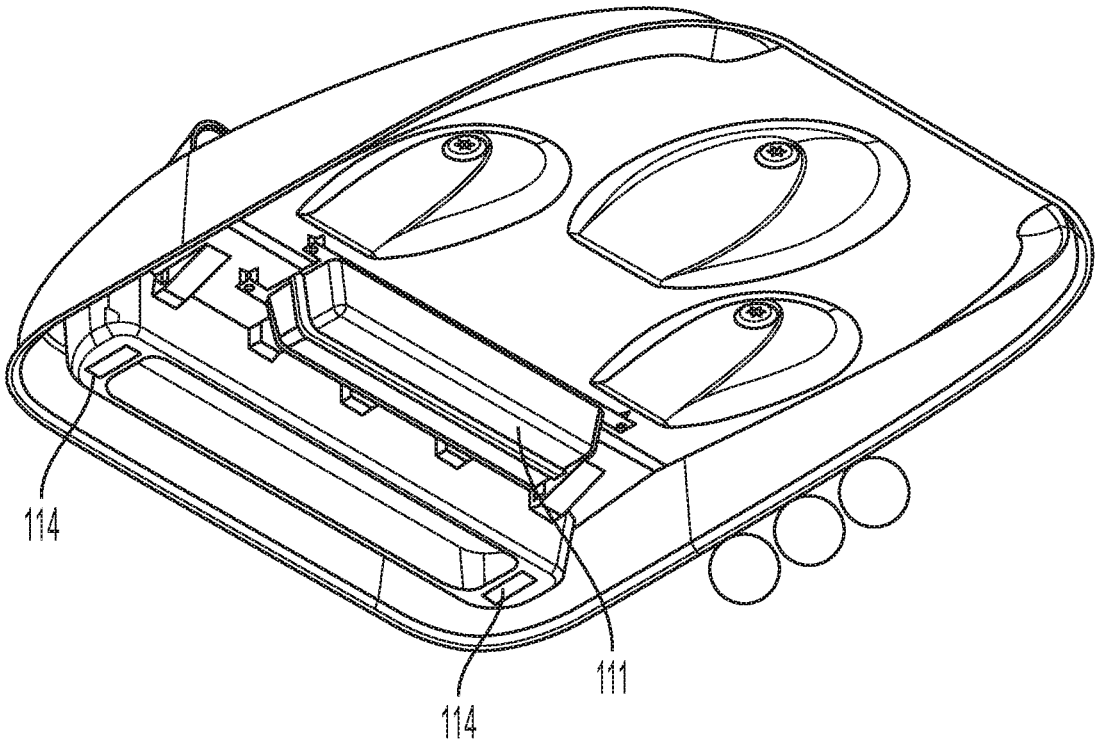
FIG. 4 illustrates an underside view of an example portable game.

As shown in FIG. 4, the portable game 100 may include a storage pocket 111 located on an underside of the portable game 100. The storage pocket 111 may be attached to the underside of the portable game 100 by one or more screws, connectors, fasteners and/or the like. In an embodiment, the storage pocket 111 may contain a zipper chain and zipper to open and close the pocket. The storage pocket 111 may be sized to receive and store one or more game pieces 105, and may be fabricated from a variety of materials such as, for example, cotton, nylon, mesh, polyester and/or the like. In some embodiments, the storage pocket 111 may be a mesh storage pocket that is sized to encompass three game pieces 105. Additional and/or alternate sized and/or fabricated storage pockets 111 may be used within the scope of this disclosure. Additionally, as shown in FIG. 4, the portable game 100 may include one or more feet 114 attachable to the bottom side of the portable game 100 to prevent the portable game 100 from sliding. A foot 114 may contain adhesive on one side that allows it to attach to the bottom side of the portable game 100.

The objective of the portable game 100 is for a player to move a game piece 105 across the playing surface 101 (such as by rolling or sliding) and into the opening 108 of a container 104 that is in a scoring position. The border rails 102 surround at least a portion of the playing surface 101 to prevent a game piece 105 from rolling or sliding off the playing surface 101. In addition, the border rails 102 may be used during game play to bank or bounce a game piece 105. In an embodiment, the portable game 100 may include one or more adjustable legs (not shown) for adjusting the height and angle of the playing surface 101. Alternatively, the portable game 100 may not include legs, but may be positioned on an inclined surface instead. The portable game 100 may have a handle or strap for carrying purposes.

In various embodiments, the playing surface 101 of the portable game 100 may have a first portion 110 and a second portion 112, as shown in FIGS. 1 and 2. In some embodiments, the second portion may be angled relative to the first portion. The first portion 110 may include at least one container 104 that is rotatably connected to the first portion via a rotating mechanism. The rotating mechanism may allow the container 104 to rotate between a scoring position and a closed position. In the scoring position, the opening 108 of the container 104 may be substantially perpendicular to the playing surface 101. When the container 104 is in the scoring position, as shown in FIG. 1, a game piece 105 is able to enter the container 104 from the playing surface 101 via the opening 108 of the container. In the closed position, as shown in FIG. 2, the opening 108 of the container 104 lies in a plane that is substantially parallel to the playing surface 101. When the container 104 is in the closed position, it may block a game piece 105 from entering the container 104 from the playing surface 101 via the opening.

In an embodiment, a rotating mechanism may automatically rotate a container 104 when a game piece 105 enters or is removed from the container 104. More specifically, the rotating mechanism may automatically rotate a container 104 from the scoring position to the closed position in response to receiving a game piece 105 via its opening 108 The rotating mechanism may automatically rotate the container 104 from the closed position to the scoring position in response to a game piece 105 being removed from the container 104.

Figure 5A:
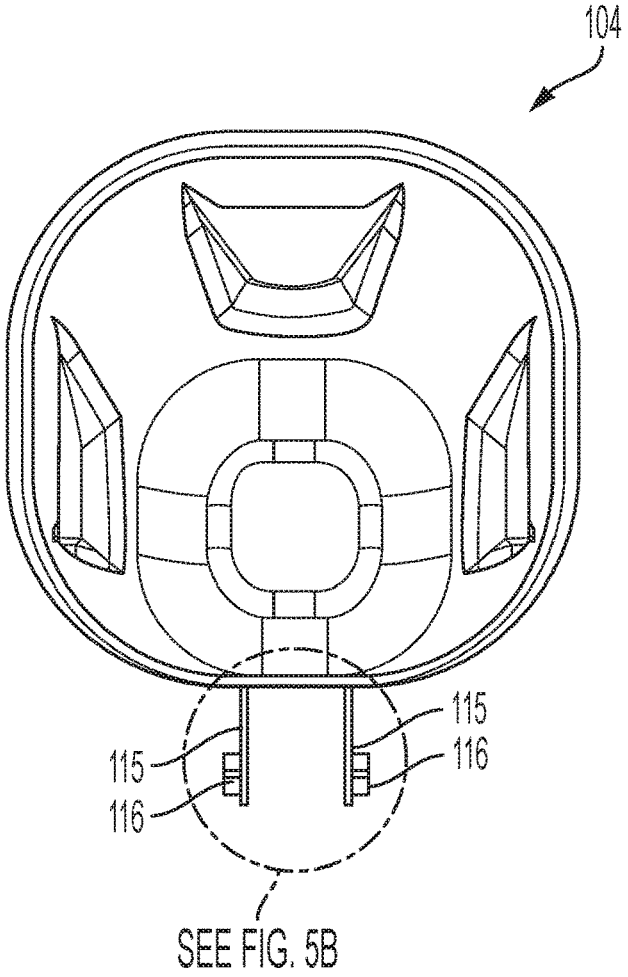
FIGS. 5A and 5B illustrate an example container having fins.
Figure 5B:
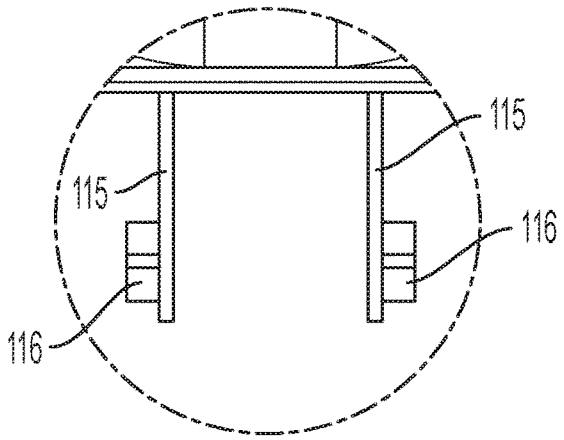

In an embodiment, one or more containers 104 may include two fins 115, as illustrated in FIG. 5A and FIG. 5B. A fin 115 may be a surface that extends outwardly from a side of a container 104, as illustrated by FIG. 5. A fin 115 may be permanently attached to a container. Alternatively, a fin 115 may be removeably attached to a container. As illustrated by FIG. 5, a fin 115 may be located on a side of a container 104 that is configured to contact the first portion 110 of the playing surface 101 when the container is in a scoring position (this side is referred to in this disclosure as the bottom side of the container).

Figure 6:
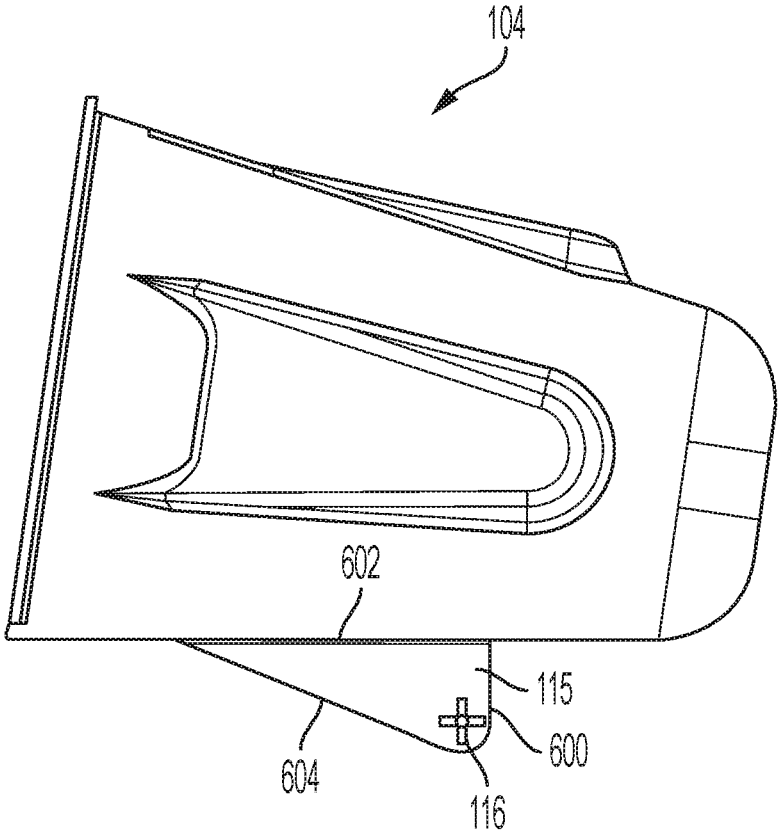
FIG. 6 illustrates a side view of an example container with a fin and protrusion.

As illustrated in FIG. 6, the profile of a fin 115 may have a generally triangular shape. A fin may have a first edge 600 that extends downwardly and perpendicular to the bottom side of the container, a second edge 602 that extends across at least a portion of the bottom side of the container, and a third edge 604 that is angled and connects the first edge and the second edge.

As shown in FIGS. 5A, 5B and 6, each fin 115 may include one or more a protrusions 116 on an outer surface of the fin 115. The one or more protrusions 116 may extend outwardly from the fin 115, and may have a variety of shapes and/or sizes. For instance, a protrusion 116 may have a cross shape, a circular shape, a rectangular shape and/or the like.

Figure 8:
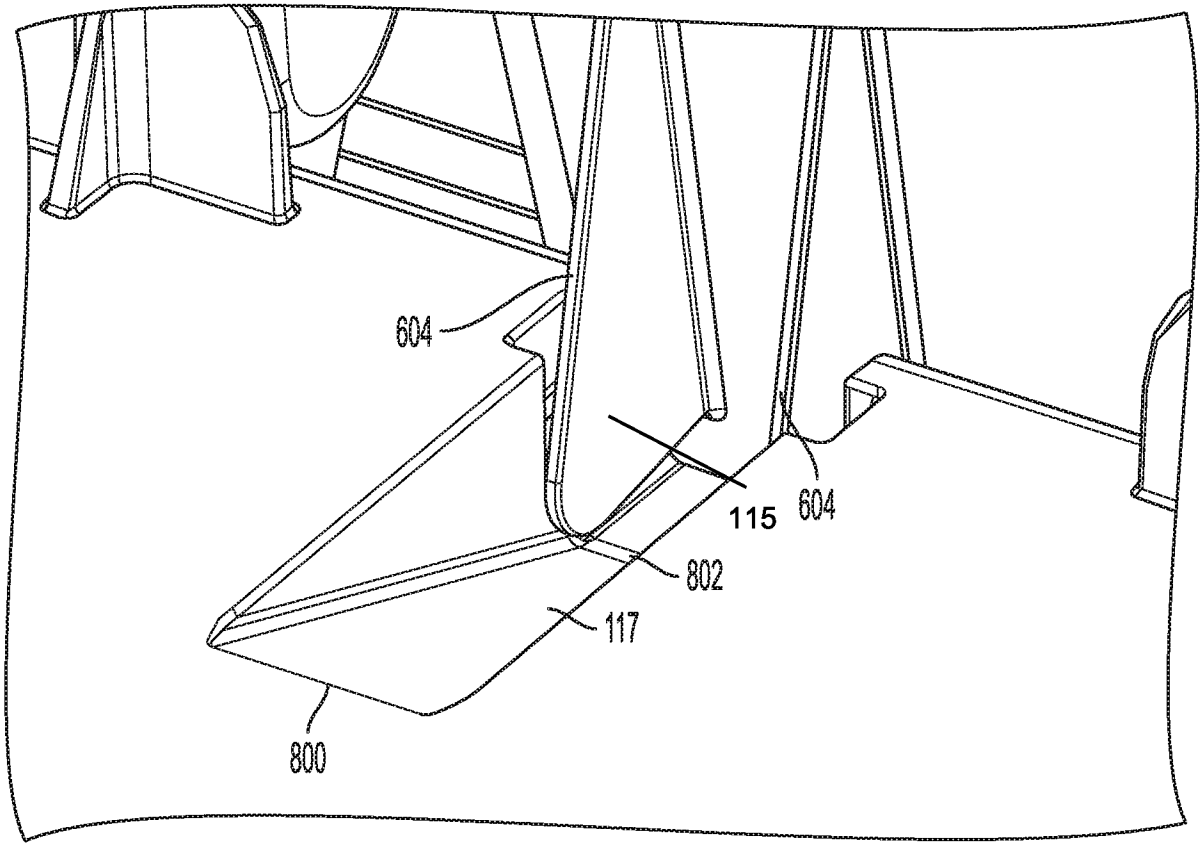
FIGS. 8 and 9 illustrate example ramp portions of a playing surface.

In an embodiment, the playing surface may include one or more ramp portions 117 that each correspond to a container. FIG. 8 illustrates an example ramp portion 117 according to an embodiment. As illustrated by FIG. 8, a ramp portion 117 may be a portion of the playing surface that is recessed below the playing surface. The ramp portion 117 may be recessed below the playing surface at an angle such that a first end 800 of the ramp portion is positioned at an angle that is above a second end 802 of the ramp portion. A ramp portion 117 may be configured and sized to receive the fins 115 of a container. For instance, the ramp portion 117 be sized and shaped such that the third edge 604 of fins 115 of a container may contact the ramp portion when the container is in a scoring position and a bottom portion of the opening 108 of the container is flush with the playing surface.

Figure 9:
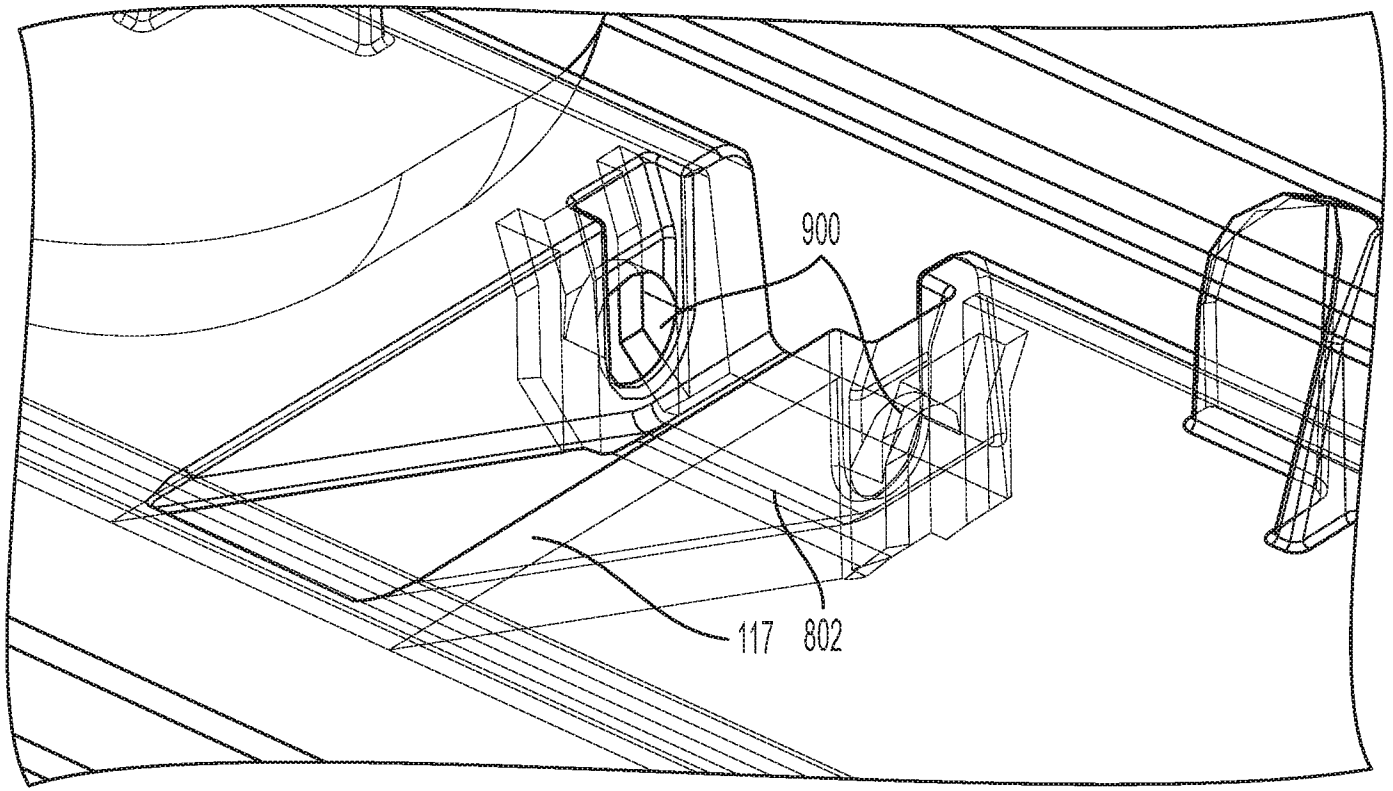

As illustrated by FIG. 9, in an embodiment, the playing surface may include an opening 900 through at least a portion of the playing surface on either side of a ramp portion 117 above the second end 802 of the ramp portion. Each opening 900 may be sized to receive a protrusion of a fin. The width of the ramp portion 117 may be such that one or both fins of a container are flexed inwardly for the protrusion of a fin to be positioned in an opening 900 of the playing surface. Positioning the protrusion of each fin of the container in the corresponding opening 900 of the playing surface establishes a rotatable connection between the container and the playing surface. When a container positioned in a scoring position receives a game piece via the opening of the container, the weight and/or force of a game piece will cause the container to rotate about the protrusions from a scoring position to a closed position. Similarly, when a game piece is removed from a container that is in a closed position, the removal of the weight from the container will cause the container to rotate about the protrusions from a closed position to a scoring position.

In various embodiments, a container 104 may include one or more markings 106 on an outer portion of the container 104. FIG. 2 illustrates example markings 106 according to an embodiment. The markings 106 may be integrally formed with the container or may be attachable to the container, such as a sticker. A marking 106 may indicate a point score associated with a container 104 and may be an alphanumeric character, an image, a graphic, a symbol, and/or the like.

For example, the first portion of the playing surface 101 may include five containers, as shown in FIG. 2. The middle container may include a number '5' on an outer portion, the containers to the immediate left and right of the middle container may include a number '3' on the outer portion, and the outer most containers 104 may include a number '1' on the outer portion. These values may represent point values that a player may receive for successfully sliding or rolling a game piece into the associated container when the container is in a scoring position.

In various embodiments, the second portion 112 of the playing surface 101 may include one or more bumper holders 103. Each bumper holder 103 is configured to hold a bumper 107. FIG. 7 shows an example bumper 107 according to an embodiment. A bumper 107 may be fabricated from any suitable materials such as, for example, plastic, rubber, and/or the like. A bumper 107 may be a component configured to stop and/or redirect motion of a game piece 105. For instance, a game piece 105 that is not received by a container 104 in a scoring position may be deflected such that is slides and/or rolls back down the playing surface 101. A bumper 107 may impede the motion of the game piece 105 such that the game piece is stopped within a bumper holder 103. Alternatively, a game piece 105 may bounce off of a bumper 107 such that its motion is redirected.

Figure 7A:
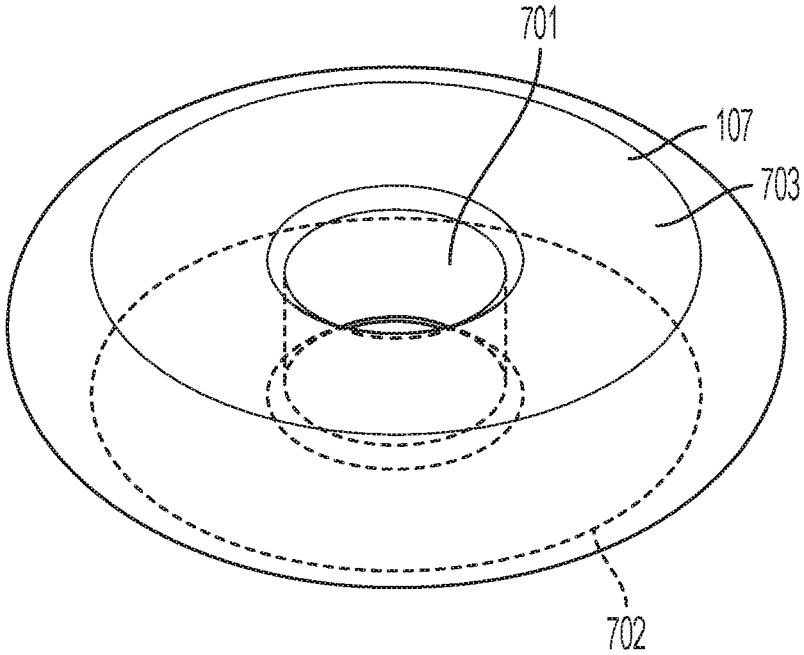
FIG. 7A illustrates an example bumper.
Figure 7B:
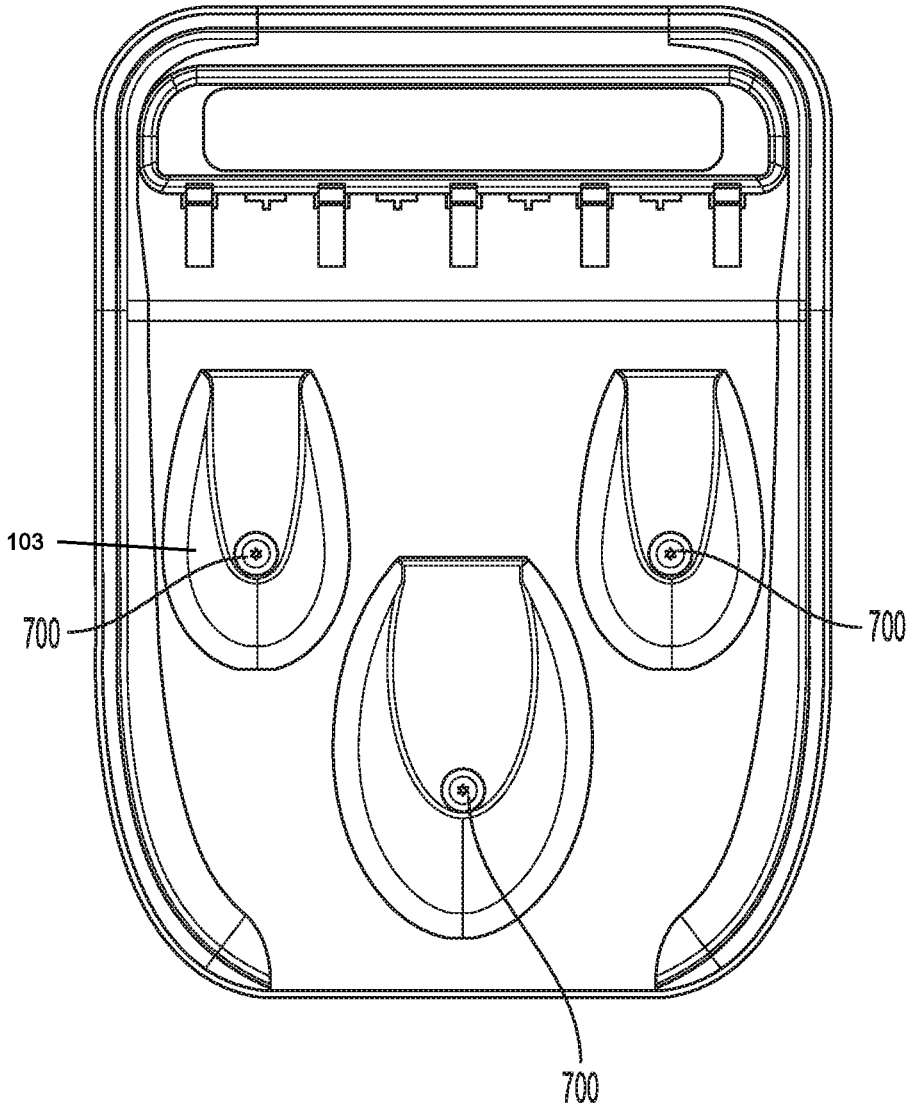
FIG. 7B illustrates an example bumper holder.

A bumper holder 103 may include a protrusion 700 as illustrated in FIG. 7B. The protrusion 700 may extend upwardly from the bumper holder 103. As illustrated in FIG. 7A, a bumper 107 may include an opening 701. The opening 701 may be positioned in a center portion of a bumper 107 and may extend from a bottom portion 702 of a bumper toward a top portion 703 of the bumper.

In various embodiments, a bumper 107 may be positioned within a bumper holder by placing the protrusion of a bumper holder 103 through at least a portion of an opening 701 of a bumper 107. This connection secures the bumper 107 to the bumper holder 103. To remove a bumper 107, a player may remove the bumper from the protrusion 700. The bumpers 107 at least partially obstruct a path of the surface to one or more containers 104 and are used to deflect a game piece 105. The bumper holders 103 can be permanent or removable, such as being integrally formed with the playing surface 101 or being able to attach to the playing surface 101 by screws or a snap-fit connection.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A portable game comprising:

a playing surface comprising:

a first portion and a second portion, the first portion having at least one container, wherein:

each container has an opening and is rotatably connected to the first portion, each container is configured to rotate between a scoring position and a closed position, the opening of each container is configured to receive a game piece via the playing surface when that container is in the scoring position but not when that container is in the closed position, and each container comprises a first fin extending from a side of the container, and a second fin extending from the side of the container, and wherein each first fin comprises a first protrusion, and each second fin comprises a second protrusion, one or more ramp portions, wherein each ramp portion is at least partially recessed below the playing surface at an angle, a first opening positioned on one side of one of the one or more ramp portions and configured to receive the first protrusion of one of the at least one container, and a second opening positioned on a second side of the one of the one or more ramp portions and configured to receive the second protrusion of the one of the at least one container, wherein the one of the at least one container is configured to rotate about the first protrusion and the second protrusion of the at least one container; and one or more border rails that at least partially surround at least a portion of the playing surface.

2. The portable game of claim 1, wherein each container is configured to automatically rotate from the scoring position to the closed position in response to receiving the game piece via its opening.

3. The portable game of claim 1, wherein each container is configured to automatically rotate from the closed position to the scoring position in response to the game piece being removed from the container.

4. The portable game of claim 1, wherein the opening of each container is substantially perpendicular to the playing surface when the container is in the scoring position.

5. The portable game of claim 1, wherein the opening of each container lies in a plane that is substantially parallel to the playing surface when the container is in the closed position.

6. The portable game of claim 1, wherein the second portion comprises:

one or more bumper holders having one or more protrusions; and one or more corresponding bumpers removeably attached to one or more of the bumper holders via one or more of the protrusions.

7. The portable game of claim 1, wherein each container comprises a visual indication on an outer portion of the container as to a point score associated with the container.

8. A portable game comprising:

a playing surface, wherein the playing surface comprises:

a first portion having a plurality of containers, wherein:

each container has an opening and is rotatably connected to the first portion, each container is configured to rotate between a scoring position and a closed position, the opening of each container is configured to receive a game piece via the playing surface when that container is in the scoring position but not when that container is in the closed position, and each container comprises a first fin extending from a side of the container, and a second fin extending from the side of the container, wherein each first fin comprises a first protrusion, and each second fin comprises a second protrusion, one or more ramp portions, wherein each ramp portion is at least partially recessed below the playing surface at an angle, a first opening positioned on one side of one of the one or more ramp portions and configured to receive the first protrusion of one of the plurality of containers, and a second opening positioned on a second side of the one of the one or more ramp portions and configured to receive the second protrusion of the one of the plurality of containers, wherein the one of the plurality of containers is configured to rotate about the first protrusion and the second protrusion of the one of the plurality of containers, and a second portion having one or more bumper holders and one or more corresponding bumpers within the bumper holders; and one or more border rails that at least partially surround at least a portion of the playing surface.

9. The portable game of claim 8, wherein each container is configured to automatically rotate from the scoring position to the closed position in response to receiving the game piece via its opening.

10. The portable game of claim 8, wherein each container is configured to automatically rotate from the closed position to the open position in response to the game piece being removed from the container.

11. The portable game of claim 8, wherein the opening of each container is substantially perpendicular to the playing surface when the container is in the scoring position.

12. The portable game of claim 8, wherein the opening of each container is substantially co-planar to the playing surface when the container is in the closed position.

13. The portable game of claim 8, wherein each container comprises a visual indication on an outer portion of the container as to a point score associated with the container.

14. The portable game of claim 8, further comprising one or more deflectors positioned on the playing surface between at least two of the plurality of containers.

* * * * *